United States Patent [19]

Wolters et al.

[11] 4,373,642

[45] Feb. 15, 1983

[54] MATERIAL HANDLING TOTE

[75] Inventors: Richard H. Wolters, Grand Rapids; William C. Anderson; Charles R. Tyke, both of Cascade; Charles P. Schreiner, Saugatuck, all of Mich.

[73] Assignee: Westinghouse Electric Corp., Pittsburgh, Pa.

[21] Appl. No.: 212,946

[22] Filed: Dec. 4, 1980

[51] Int. Cl.[3] ..... B65D 1/22; B65D 6/34; B65D 21/02

[52] U.S. Cl. ..... 220/72; 206/503; 206/509; 206/519; 220/307

[58] Field of Search ..... 206/509, 519, 505, 503; 220/72, 74, 307, 73, 71, 23.4

[56] References Cited

U.S. PATENT DOCUMENTS

| | | | |
|---|---|---|---|
| 2,878,959 | 3/1959 | Nawman | 206/505 |
| 3,193,132 | 7/1965 | Gray | 220/307 |
| 3,252,614 | 5/1966 | Evans | 206/509 |
| 3,311,257 | 3/1967 | Puerte | 220/72 |
| 3,344,974 | 10/1967 | Bostron | 220/72 |
| 3,347,394 | 10/1967 | Gould | 206/509 |
| 3,380,616 | 4/1968 | Schoeller | 206/509 |
| 3,530,981 | 9/1970 | Wienecke | 220/307 |
| 3,572,537 | 3/1971 | Baltzer | 220/23.4 |
| 3,918,600 | 11/1975 | Lyon | 206/509 |
| 4,278,196 | 7/1981 | Ford | 220/4 F |

FOREIGN PATENT DOCUMENTS

| | | | |
|---|---|---|---|
| 1905747 | 9/1969 | Fed. Rep. of Germany | 220/74 |
| 2740262 | 3/1979 | Fed. Rep. of Germany | 220/74 |

*Primary Examiner*—George E. Lowrance
*Attorney, Agent, or Firm*—B. R. Studebaker

[57] ABSTRACT

A material handling tote adapted for multiple storage and handling techniques. The tote includes a bottom, side and end walls and a substantially continuous multi-purpose flange at the upper edge of the side and end walls. The multi-purpose flange is constructed and arranged to releasably retain a lid, provide for stackability, include carrying grips and facilitate cantilevered hanging and retentive glide storage.

9 Claims, 8 Drawing Figures

MATERIAL HANDLING TOTE

BACKGROUND OF THE INVENTION

In modern manufacturing processes, particularly those employed in the electronics industry, there is a need for a facility to handle large numbers of comparatively small electronic parts such as printed circuit boards and the like. During these manufacturing processes, there is a need to store parts and subassemblies at various stages of those processes. For example, the parts and subassemblies need to be stored in large storage areas in large numbers and to have the ability to be moved in large quantities by industrial fork trucks and the like. These parts in smaller numbers also need to be moved from storage areas to work areas by hand carts and the like and be stored at work areas under work surfaces or on vertical wall surfaces for access by manufacturing personnel.

A system has been developed which employs a uniquely designed material handling tote which tote forms the subject matter of this application. The material handling tote of this invention may be employed in a total material handling system and may be, for example, stored in large numbers on the pallet frame disclosed in U.S. patent application Ser. No. 212,953, by Charles P. Schreiner for a Pallet Frame filed the same date as this application, or moved from place to place and stored on a push cart of the type disclosed in copending application Ser. No. 212,954, filed the same date as this application by Charles P. Schreiner for a Material Handling Cart. Additionally, the material handling tote of this invention may be supported by a wall hung support rail of the type disclosed in copending application Ser. No. 212,944, filed by Charles P. Schreiner the same date as this application for a Wall-Hung Support Rail or stored beneath a work surface on pairs of tote guides of the type disclosed in copending application Ser. No. 212,945, filed the same date as this application by Charles P. Schreiner for Tote Guide. Each of the foregoing applications are owned by the same assignee as this application.

SUMMARY OF THE INVENTION

The principal and universal component of the above-described material handling system is the tote component of this invention. The combination material handling tote and lid of this invention includes a rectangular open topped container having a bottom, a pair of side walls and a pair of end walls defining a cavity. A continuous, outwardly directed horizontal flange extends above and outwardly of the top edge of the side walls and end walls substantially parallel to the bottom of the container. The top edge of the side and end walls define a recessed seat bounded by the continuous outwardly directed horizontal flange. This recessed seat also extends inwardly at the intersections between the side walls and the end walls to overlay a portion of the container cavity at the corners. A vertical flange is provided on the outer periphery of the horizontal flange which extends substantially perpendicular to the horizontal flange and extends both above the horizontal flange for the entire periphery thereof and below the horizontal flange for a distance substantially equal to the lengths of the end walls and the side walls to thereby define openings in the flange at the corners of the container. The downwardly extending portions of the vertical flange extending below the horizontal flange define gripping or mounting means for the container. The container also includes a cover constituting a planar main portion having side edges complementing the recessed seat of the container and includes rib guides on the underside of the main portion extending perpendicular to the main portion. These rib guides include both end, side and corner rib guides which are adapted to fit within the container while the corner rib guides include outwardly directed detents which are constructed and arranged to interlock with the portions of the recessed seat which extend inwardly at the corners of the container to thereby releasably retain the lid on the tote.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
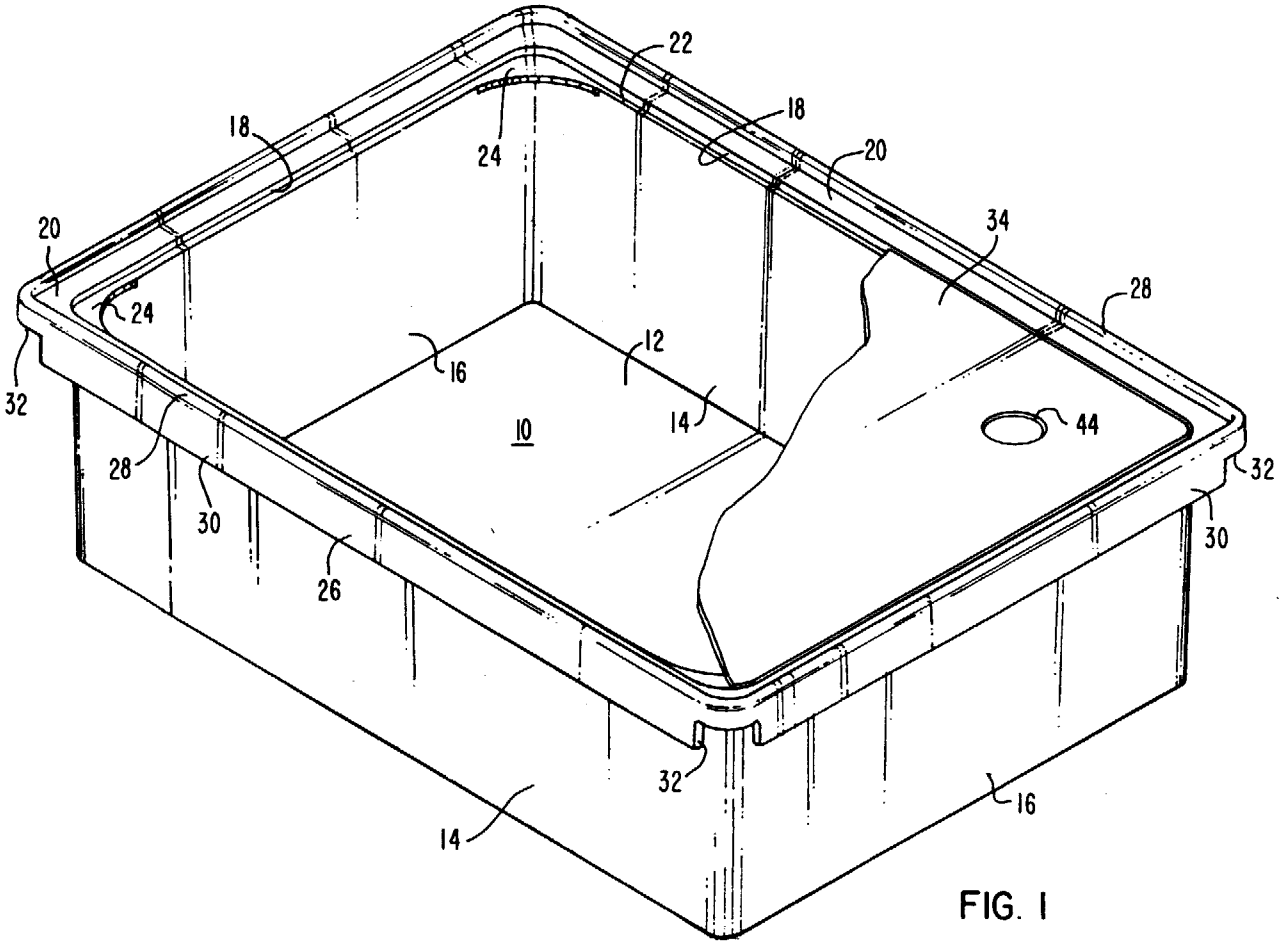
FIG. 1 is an isometric illustration of the material handling tote of this invention with a portion of the lid broken away.
Figure 2:
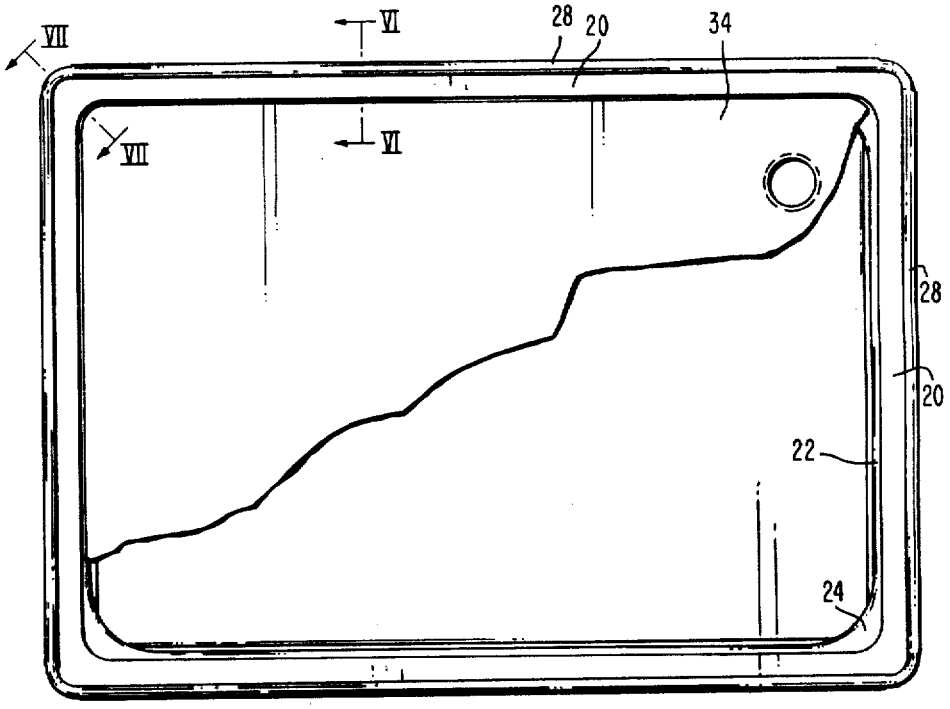
FIG. 2 is a top plan view thereof.
Figure 3:
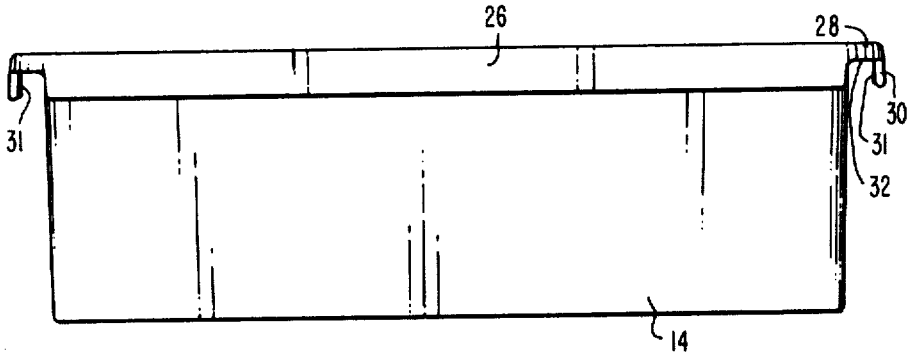
FIG. 3 is a side elevational view thereof.
Figure 4:
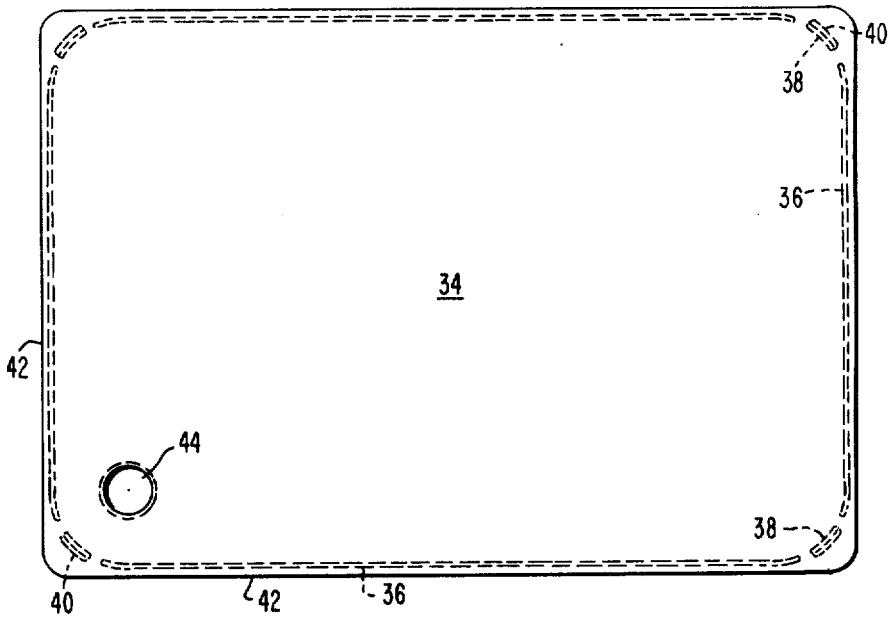
FIG. 4 is a top plan view of the lid.
Figure 5:
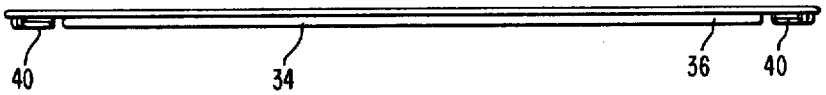
FIG. 5 is a side elevational view of the lid.

Referring now in detail to the drawing wherein like reference characters represent like parts throughout the several views, there is illustrated in FIG. 1, the material handling tote and associated lid constructed in accordance with this invention. The rectangular open topped container or tote generally designated 10 includes a bottom 12, a pair of side walls 14 and a pair of end walls 16 which define a cavity. A continuous outwardly directed horizontal flange 20 extends outwardly of and slightly above the top edge of the side walls 14 and the end walls 16 substantially parallel to the bottom 12. The top edge of the side and end walls 14, 16 define a continuous recessed seat 22 bounded by the inward edge 18 of the horizontal flange 20. The recessed seat 22 extends inwardly at the corners defined by the intersections between the side walls 14 and the end walls 16 to provide an enlarged corner portion 24 which overlies a portion of the cavity defined by the end walls and side walls. The horizontal flange 20 terminates at its outer edge in a vertical flange 26 which includes both an upper portion 28 and a lower portion 30. The upper portion 28 of the vertical flange is continuous and extends completely around and above the periphery of the horizontal flange 20. The bottom portion 30 of the vertical flange 26 extending below the horizontal flange 20 extends laterally for a distance which is substantially equal in length to and parallel with the side walls 14 and end walls 16 thereby providing openings 32 at each of the corners of the material handling tote 10. The bottom portions 30 of each of the vertical flanges 26 are also provided with a series of equidistantly spaced small raised ribs 31 on their inner surfaces which serve to spread the load equidistantly across the flange 30 when the tote is hung in a cantilevered fashion from a support rail. The ribs 31 compensate for any slight variations in the flange structure which would cause the load to be concentrated at a single point along the inner surface of the flange. For example, there are preferably five such ribs 31 along a side flange 30 and four along an end flange.

A generally planar cover 34 is provided for the material handling tote 10. The cover 34 includes on its underside a plurality of side and end rib guides 36 which extend perpendicular to the main planar portion 34 of the lid. The underside of the lid 34 also includes corner rib guides 38 which include detents 40 at the ends thereof which are constructed and arranged to interlock with the corner portions 24 of the seat 20 to releasably retain the lid member 34 in the seat 22 at the top of the side and end walls of the container. The outer edges 42 of the lid are complementary to the inner edge 18 of the continuous flange 20 to thereby permit the lid to sit flush with the flange 20 on the seat or recess 22. The lid 34 is also provided with a finger aperture 44 to provide for the removal of the lid 34 from the tote 10 in opposition to the releasable grip of the detents 40 on the corner portions 24 of the seat 22.

Figure 6:
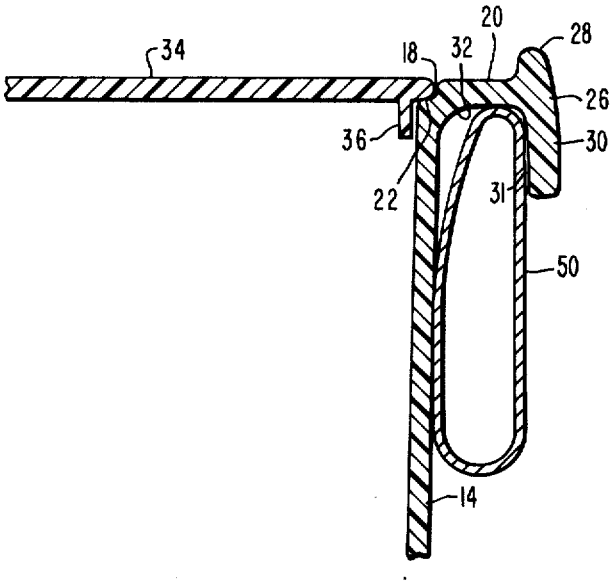
FIG. 6 is a sectional view taken along the line VI—VI of FIG. 2 and also illustrating one method of supporting the material handling tote of this invention.
Figure 7:
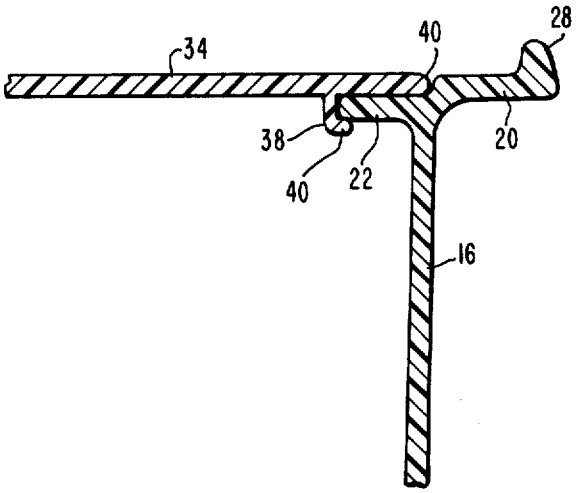
FIG. 7 is a sectional view taken along the line VII—VII of FIG. 2.
Figure 8:
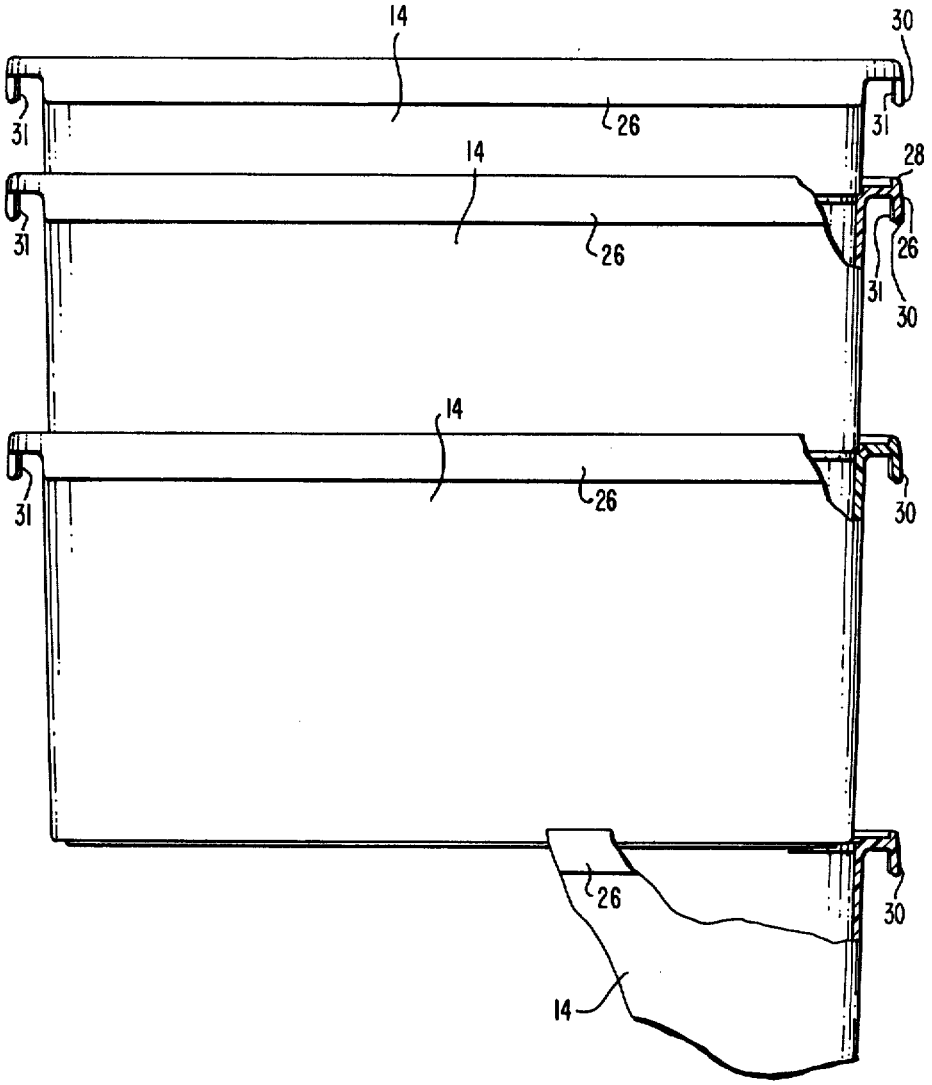
FIG. 8 is a side elevational view of several totes illustrating the stackability thereof.

The uniquely designed material handling tote of this invention with its multi-purpose flange, the apertures 32 at the corners of the flanges permit the tote to be hung from a support rail of the type illustrated at 50 in FIG. 6 along either its side edge or its end edge in a cantilevered fashion. Each of the tote's side and end walls have a slight, preferably 1.5° taper which permits the totes to be stacked one upon the other with the bottom of the upper tote readily fitting into the seat or recess 22 of the next lower tote as illustrated in FIG. 8. The totes may be manufactured in varying height dimensions, but are preferably a family of totes being, for example, 3 inches, 6.25 inches, 9.5 inches and 12.75 inches in height and will seat one upon the other in the fashion illustrated in FIG. 8.

As indicated supra, the material handling tote of this invention is part of the total material handling system and can be employed in connection with a pallet frame for large quantity handling and storing of the type disclosed in copending application Ser. No. 212,953, filed by Charles P. Schreiner, the same day as this application for a Pallet Frame. The material handling tote 10 will hang on a plurality of vertically aligned horizontal rails of the type illustrated at 50 in that environment. The material handling totes of this invention can be manipulated in lesser quantities on a push cart of the type disclosed in application Ser. No. 212,954, filed the same date as this application by Charles P. Schreiner for a Push Cart. In that environment, the tote again hangs from a rail on the push cart in the manner illustrated in FIG. 6. In another application, individual storage of the tote of this invention can be accomplished by hanging the tote 10 from a wall hung support rail of the type disclosed in copending application Ser. No. 212,944, filed the same day as this application by Charles P. Schreiner for a Wall Hung Support Rail, again on a horizontal rail similar to the rail 50 of FIG. 6. Because of the configuration of the flanges 26, the material handling tote can also be supported on tote guides mounted beneath a work surface in the manner illustrated in copending application Ser. No. 212,945, filed the same day as this application by Charles P. Schreiner for a Tote Guide. In that environment, the upper portion 28 of the vertical flange 26 serves to prevent the material handling tote from being inadvertently removed from the tote guide by interacting with a depending detent on an upper rail of the tote guide to inhibit the removal of the tote from the tote guide unless the tote is tilted to allow the upper portion 28 of the flange 26 to pass the depending detent.

Additionally, the combination of the horizontal flange 20 and the bottom portion 30 of the vertical flange 26 form gripping means for the manual carrying of the tote 10 either along its end edges or its side edges as is individually preferable.

As will be apparent from the foregoing, the unique construction of the material handling tote of this invention provides for versatile utilization in a number of environments to facilitate the material handling of electronic or similar parts in a manufacturing process. The material handling tote may be utilized for bulk storage applications, material transfer applications as well as parts storage at individual work stations by virtue of its configuration and additionally may be cantilevered for such applications from either its end or side flanges as well as it may be stored beneath a work surface on tote guides along either its end flanges or side flanges.

What is claimed is:

1. A material handling tote comprising:

a bottom wall, a pair of side walls and a pair of end walls defining an open top container;

a continuous flange extending outwardly from the upper edge of said side walls and said end walls, said continuous flange having at its outer edge a vertical flange having an upper portion extending above said continuous flange and a lower portion extending below said continuous flange, said lower portions being substantially equal in length to their adjacent end and side walls thereby providing open corners for lateral access to the space between said end walls and said side walls and their adjacent lower portions of said vertical flange; and a plurality of raised ribs on the inner surface of the lower portions of said vertical flange, said raised ribs constructed and arranged to spread the load equidistantly across said vertical flange when said material handling tote is hung from a support rail.

2. The material handling tote according to claim 1 wherein said continuous outwardly extending flange includes a continuous recessed seat adjacent its inner edge, said continuous seat including substantially wider corner portions overlying a portion of the open top of said container.

3. The material handling tote according to claim 2 wherein a lid closes off the open top thereof, said lid comprising a planar portion having edges complementary to said continuous recessed seat of said continuous flange, said lid further including a plurality of perpendicularly extending ribs on the underside thereof adjacent the edges thereof constructed and arranged to be received within said container adjacent said side and end walls.

4. The material handling tote according to claim 2 wherein said end walls and said side walls taper at a slight angle whereby the bottom of one such tote will nest on the continuous recessed seat of another of said material handling totes.

5. A combination material handling tote and lid, said combination comprising:

a rectangular open-topped container having a bottom, a pair of side walls and a pair of end walls defining a cavity;

a continuous outwardly directed horizontal flange extending above and outwardly of the top edge of said side walls and said end walls substantially parallel to said bottom, said top edge of said side and end walls defining a recessed seat bounded by said continuous horizontal flange, said recessed seat extending inwardly at the intersections between said side walls and said end walls to overlie a portion of said cavity;

a vertical flange on the outer periphery of said horizontal flange extending substantially perpendicular thereto, said vertical flange extending above said horizontal flange for the entire periphery thereof and below said horizontal flange for a distance substantially equal to the lengths of said end walls and said side walls thereby defining openings in said flange at the corners of said container, said portions of said flange extending below said horizontal flange defining gripping or mounting means for said container;

a cover for said container, said cover including a planar main portion having side edges complementary to said seat and rib guides on the underside of said main portion extending perpendicular thereto, said rib guides including side, end and corner rib guides, said side and end rib guides adapted to fit within said container while said corner rib guides include outwardly directed detents which are constructed and arranged to interlock with said portions of said seat extending inwardly at the intersections of said side walls and said end walls of said container.

6. The material handling tote according to claim 5 wherein said end walls and said side walls taper at a slight angle whereby the bottom of one such tote will nest on the continuous seat of another of said material handling totes.

7. The material handling tote according to claim 5 wherein said lid includes a finger aperture therethrough to facilitate removal of said lid from said tote.

8. The material handling tote according to claim 5 wherein the portion of said vertical flange extending below said horizontal flange include a plurality of equidistantly spaced raised ribs on the surface thereof facing said end and side walls.

9. A material handling tote comprising:

a bottom wall, a pair of side walls and a pair of end walls defining an open top container;

a continuous flange extending outwardly from the upper edge of said side walls and said end walls, said continuous flange having at its outer edge a vertical flange having an upper portion extending above said continuous flange and a lower portion extending below said continuous flange, said lower portions being substantially equal in length to their adjacent end and side walls thereby providing open corners for lateral access to the space between said end walls and said side walls and their adjacent lower portions of said vertical flange;

a continuous recessed seat adjacent the inner edge of said continuous outwardly extending flange, said continuous seat including substantially wider corner portions overlying a portion of the open top of said container; and a lid closing off said open top, said lid comprising a planar portion having edges complimentary to said continuous recessed seat of said continuous flange, said lid further including a plurality of perpendicularly extending ribs on the underside thereof adjacent the edges thereof constructed and arranged to be received within said container adjacent said side and end walls, said perpendicularly extending ribs on the underside of said lid including arcuate ribs adjacent the corners of said lid, said arcuate ribs including outwardly extending detents at the edges thereof constructed and arranged to snap over said corner portions of said seat to thereby releasably retain said lid on said material handling tote.

* * * * *